US009232845B2

(12) United States Patent
Drugeon et al.

(10) Patent No.: US 9,232,845 B2
(45) Date of Patent: Jan. 12, 2016

(54) TOUCH SENSOR APPLICATION DEVICE FOR COSMETIC PRODUCT, AND A COSMETIC PRODUCT APPLICATION METHOD USING SUCH A DEVICE

(71) Applicant: L'OREAL, Paris (FR)

(72) Inventors: Lionel Drugeon, La Garenne Colombes (FR); Jean-Marc Lebrand, Pantin (FR)

(73) Assignee: L'Oreal, Paris (FR)

( * ) Notice: Subject to any disclaimer, the term of this patent is extended or adjusted under 35 U.S.C. 154(b) by 41 days.

(21) Appl. No.: 14/104,194

(22) Filed: Dec. 12, 2013

(65) Prior Publication Data

US 2014/0174464 A1 Jun. 26, 2014

(30) Foreign Application Priority Data

Dec. 20, 2012 (FR) ..... 12 62486

(51) Int. Cl.

| | |
|---|---|
| ***A45D 40/06*** | (2006.01) |
| ***A45D 40/18*** | (2006.01) |
| ***A45D 40/02*** | (2006.01) |
| ***A45D 33/00*** | (2006.01) |
| ***A45D 34/00*** | (2006.01) |
| ***A45D 33/30*** | (2006.01) |

(52) U.S. Cl.

CPC ..... *A45D 40/023* (2013.01); *A45D 33/00* (2013.01); *A45D 33/30* (2013.01); *A45D 34/00* (2013.01); *A45D 40/06* (2013.01); *A45D 40/18* (2013.01)

(58) Field of Classification Search

CPC ..... A45D 40/00; A45D 40/02; A45D 40/06

USPC ..... 401/49, 52, 55, 99; 318/286, 466; 307/116, 117

See application file for complete search history.

(56) References Cited

U.S. PATENT DOCUMENTS

| | | | | |
|---|---|---|---|---|
| 7,629,757 | B2 | 12/2009 | Murphy et al. | |
| 2008/0025785 | A1 * | 1/2008 | Ma et al. | 401/87 |
| 2008/0230086 | A1 * | 9/2008 | Murphy et al. | 132/320 |

* cited by examiner

*Primary Examiner* — Kevin P Shaver
*Assistant Examiner* — Joshua Wiljanen
(74) *Attorney, Agent, or Firm* — Novak Druce Connolly Bove + Quigg LLP

(57) ABSTRACT

The application device (12) for a cosmetic product (16) comprises a receptacle (20) and a cosmetic article (22), the cosmetic article (22) being suitable for moving relative to the receptacle (20) between a retracted position inside the receptacle (20) and an extended position outside the receptacle (20), the cosmetic article (22) comprising a body (34) and the cosmetic product (16) housed inside the body (34), the body (34) defining a cosmetic product (16) outlet orifice (38) from the body (34).

Figure 3:
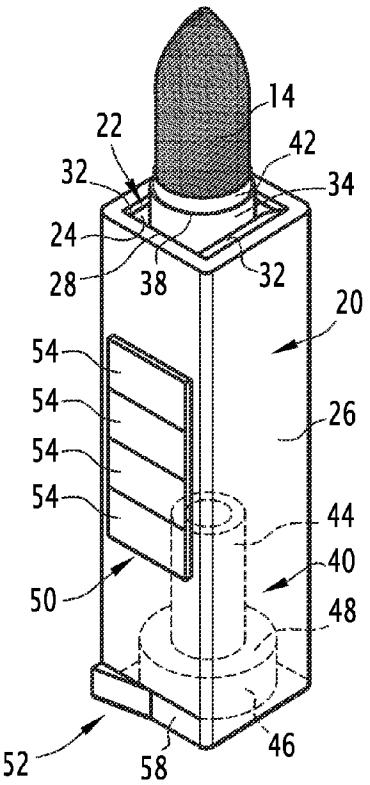

The application device (12) further comprises an electromechanical device (40) for moving the cosmetic product (14, 16) relative to the body (34), and an assembly (50) for controlling the electromechanical device (40) for adjusting the position and/or movement of the cosmetic product (16) relative to the body (34), the control assembly (50) being suitable for switching between:

- an idle state when the cosmetic article (22) is in the retracted position, and
- an active state when the cosmetic article (22) is in the extended position.

16 Claims, 2 Drawing Sheets

TOUCH SENSOR APPLICATION DEVICE FOR COSMETIC PRODUCT, AND A COSMETIC PRODUCT APPLICATION METHOD USING SUCH A DEVICE

CROSS REFERENCE TO RELATED APPLICATIONS

This application claims priority to Application No. 12 62486 filed in France on Dec. 20, 2012 under 35 U.S.C. §119, the entire contents of which are hereby incorporated by reference.

The present invention relates to an application device for a cosmetic product, of the type comprising a receptacle and a cosmetic article, the cosmetic article being suitable for moving relative to the receptacle between a retracted position inside the receptacle and an extended position outside the receptacle, the cosmetic article comprising a body and the cosmetic product housed inside the body, the body defining a cosmetic product outlet orifice from the body.

The cosmetic product is for example a makeup product, particularly for a users lips. Alternatively, the cosmetic product is a care product for a surface of a user's body. More generally, a cosmetic product is a product as defined in EC Regulation N° 1223/2009 of the European Parliament and the Council of Nov. 30, 2009, relating to cosmetic products.

Such an application device is known from U.S. Pat. No. 7,629,757, describing a lipstick tube comprising a lipstick receptacle, a spiral tube housed in the receptacle, and a lipstick bullet housed in the spiral tube. Together, the bullet and spiral tube form a cosmetic article suitable for moving relative to the receptacle between a retracted position inside the receptacle, wherein the bullet is contained in the spiral tube and in the receptacle, and an extended position outside the receptacle, wherein the bullet extends through an outlet orifice of the spiral tube and at least partially outside the receptacle.

An electromechanical device actuates the movement of the bullet relative to the spiral tube. This electromechanical device is suitable for being controlled using touch sensors arranged on an external surface of the receptacle. Actuating these touch sensors controls the movement of the cosmetic article to the extended position, and the return of the cosmetic article to the retracted position.

However, for convenience of use of a lipstick, it is necessary to be able to adjust the extended bullet length. However, such an adjustment is tedious with the lipstick tube described in U.S. Pat. No. 7,629,757. Indeed, during the extension of the cosmetic article, the user needs to remain attentive to prevent the bullet from coming too far out of the spiral tube.

One aim of the invention is that of enhancing the convenience of use of an application device for a cosmetic product, particularly of the lipstick tube type.

For this purpose, the invention relates to an application device of the aforementioned type, further comprising an electromechanical device for moving the cosmetic product relative to the body, and an electromechanical device control assembly for adjusting the position and/or movement of the cosmetic product relative to the body, the control assembly including at least one touch sensor, the control assembly being suitable for switching between:

- an idle state when the cosmetic article is in the retracted position, and
- an active state when the cosmetic article is in the extended position, wherein the or each touch sensor is suitable for being actuated by a user, and wherein actuating at least one touch sensor moves the cosmetic product relative to the body by means of the electromechanical device.

According to particular embodiments of the invention, the application device also has one or several of the following characteristics taken in isolation or in any technically possible combination:

- the electromagnetic device comprises an element for moving the cosmetic product and an actuator for actuating the movement element,
- it comprises a mechanism for moving the cosmetic article between the retracted and extended positions thereof, and an element for controlling the movement mechanism, suitable for manual actuation and separate from the or each touch sensor,
- the movement mechanism is coupled with the actuator of the electromechanical device in order to be actuated by said actuator, the control element being electrically connected to said actuator,
- in the idle state, touching at least one touch sensor has no effect on the electromechanical device,
- in the extended position of the cosmetic article, the body extends at least partially outside the receptacle,
- the cosmetic product is a cosmetic product block, for example a lipstick bullet,
- the cosmetic product is in liquid or powder form, and the cosmetic article comprises a cosmetic product applicator arranged through the outlet orifice,
- the control assembly comprises a plurality of touch sensors and a control module programmed to set the position and/or movement of the cosmetic product relative to the body according to a touch sensor actuation pattern,
- the actuation pattern has a touch sensor actuation rate, and the control module is programmed to set a cosmetic product movement rate according to said actuation speed,
- the movement rate is proportional to said actuation rate.

The invention also relates to a cosmetic product application method, comprising the following successive steps:

- providing an application device according to any of the above claims, the cosmetic article being in the retracted position, the control assembly being idle,
- moving the cosmetic article to the extended position, the control assembly being activated in the extended position,
- actuating at least one touch sensor, and
- moving the cosmetic product relative to the body.

According to one particular embodiment of the invention, the application method also has the following features:

- at least two touch sensors are actuated, and the movement of the cosmetic product relative to the body is dependent on the number of touch sensors actuated and/or an order of actuation of said touch sensors and/or an actuation rate of said touch sensors,
- the movement of the cosmetic product is independent of the position, relative to the other touch sensors, of the first touch sensor actuated.

Figure 2:
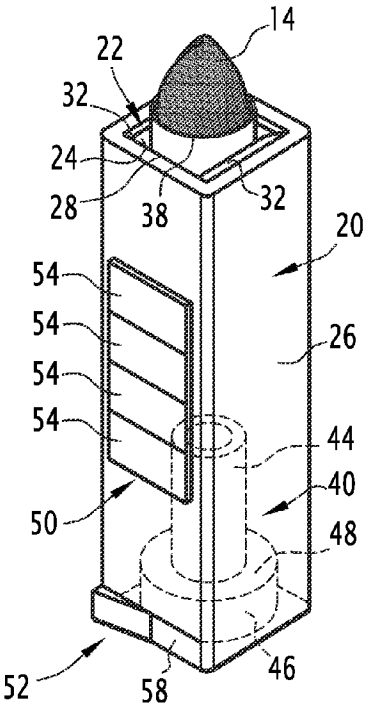
Figure 1:
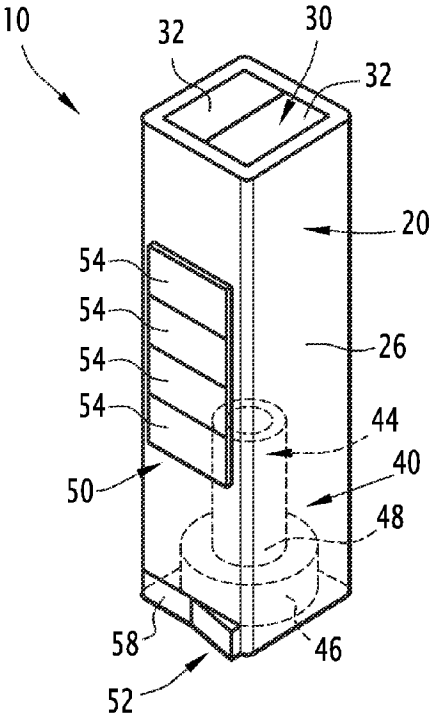
Figure 4:
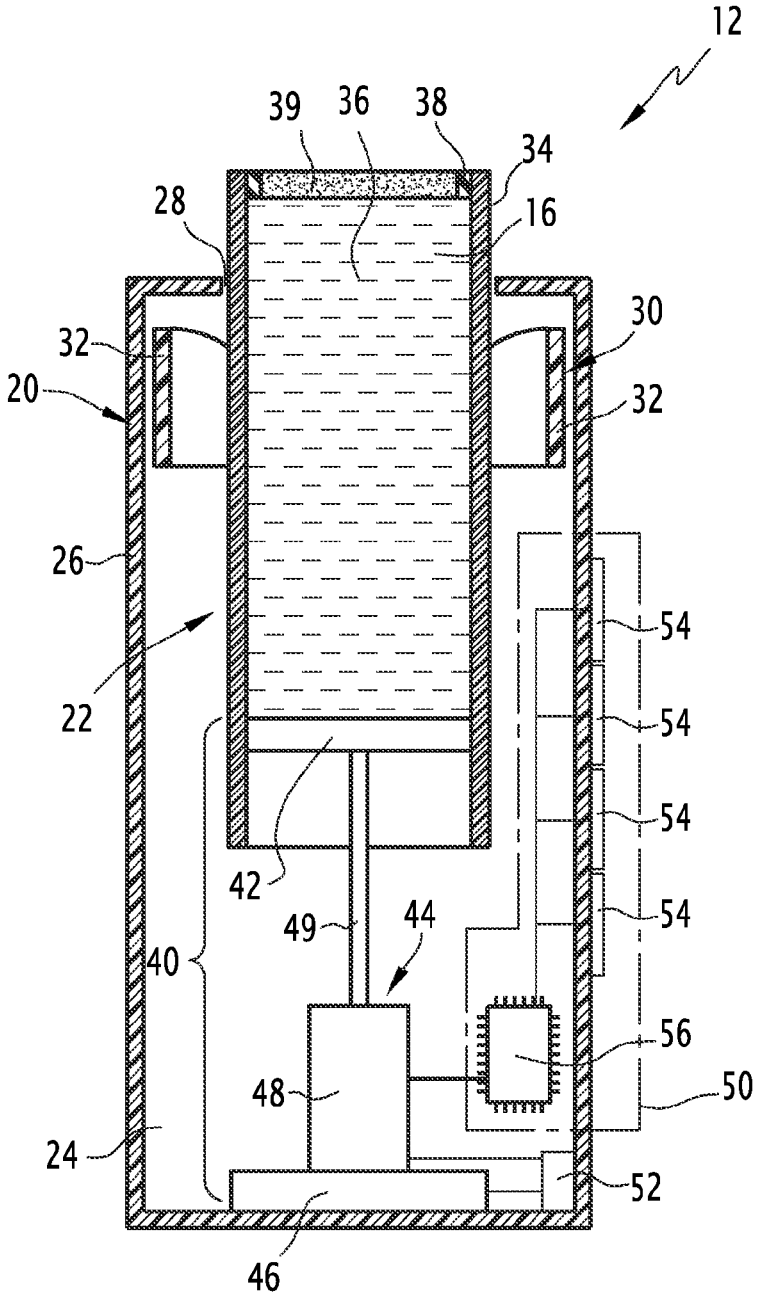

Further features and advantages of the invention will emerge after reading the following description given solely as an example with reference to the appended drawings in which:

FIG. 1 is a schematic perspective view of an application device according to a first embodiment of the invention, in a retracted configuration, FIG. 2 is a similar view to that in FIG. 1, the application device being in a first extended configuration, FIG. 3 is a similar view to that in FIG. 1, the application device being in a second extended configuration, and FIG. 4 is a schematic section view of an application device according to a second embodiment of the invention, in an extended configuration.

Each of the devices, respectively 10, 12, shown in FIGS. 1 to 4, is intended for the application of a cosmetic product, respectively 14, 16. The application device 10 according to the first embodiment, is particularly a lipstick tube, the cosmetic product 14 being a lipstick bullet. The application device 12 according to the second embodiment is an application device for lip gloss, and the cosmetic product 16 is lip gloss.

Each device 10, 12 comprises a receptacle 20 and a cosmetic article 22.

The receptacle 20 has an overall tubular shape, closed at one end. It defines an inner cavity 24 for housing the cosmetic article 22, and has an outer surface 26. The inner cavity 24 is connected to the outer surface 26 via a passage slot 28 provided in one axial end of the receptacle 20.

The receptacle 20 bears an element 30 for closing off the passage slot 28, which is movably mounted relative to the receptacle 20 between a configuration for closing the slot 28, shown in FIG. 1, wherein the element 30 extends through the slot 28, and a configuration for releasing the slot 28, shown in FIGS. 2 to 4, wherein the element 30 is away from the slot 28.

In the examples shown, this closing element 30 is a gate formed from two movable panels 32 pivotably mounted on the receptacle 20. In the configuration for closing the element 30, each movable panel 32 extends substantially perpendicular to the axis of the receptacle 20, in the slot 28, and in the configuration for releasing the element 30, each movable panel 32 extends substantially parallel to the axis of the receptacle 20, away from the slot 28.

Alternatively, the closing element 30 is a manually extractable cap. This alternative embodiment is particularly advantageous in the case of the second embodiment, since it makes it possible to reinforce the tightness of the receptacle 20 when the closing element 30 is in the closing configuration.

The cosmetic article 22 comprises a body 34, and the cosmetic product 14, 16.

The body 34 is tubular. It typically has a polygonal or circular radial cross-section. It is substantially coaxial with the receptacle 20.

The body 34 defines an inner housing 36 (FIG. 4) for the cosmetic product 14, 16, and an outlet orifice 38 for the cosmetic product 14, 16 out of the body 34. The orifice 38 is particularly provided in one axial end of the body 34.

In the first embodiment, the orifice 38 is free. In the second embodiment, an applicator 39 extends through the orifice 38. This applicator 39 is typically made of fabric, this fabric optionally being woven, non-woven, felt, braided natural fibers, or any other equivalent fabric. Alternatively, the applicator 39 is a perforated soft or hard membrane.

The cosmetic product 14, 16 is housed in the housing 36.

The cosmetic article 22 is suitable for moving relative to the receptacle 20 between a retracted position inside the receptacle 20, shown in FIG. 1, and an extended position outside the receptacle 20, shown in FIGS. 2 to 4. In each of the examples shown, in the extended position of the cosmetic article 22, the body 34 extends partially outside the receptacle 20. In particular, the body 34 extends through the passage slot 28.

Each application device 10, 12 also comprises a mechanism (not shown) for actuating the closing element 30, a mechanism (not shown) for moving the cosmetic article 22 between the extended and retracted positions thereof, and an electromechanical device 40 for moving the cosmetic product 14, 16 relative to the body 34. These mechanisms, along with the electromechanical device 40, are housed inside the receptacle 20.

The actuating and movement mechanisms have not been shown in the Figures for the purposes of clarity. Furthermore, such mechanisms are routinely known to those skilled in the art, and examples of mechanisms suitable for use within the scope of the invention are given in U.S. Pat. No. 7,629,757 and U.S. Pat. No. 7,637,371.

According to one embodiment, the electromechanical device 40 comprises an element 42 for moving the cosmetic product 14, 16, an actuator 44 for actuating the movement element 42, and a power supply battery 46 for the actuator 44.

The movement element 42 is movably mounted on the body 34 in translation along the axial direction of the body 34. In the first embodiment, the movement element 42 is a cup, bearing pins (not shown) engaging with guide rails provided in the body 34. In the second embodiment, the movement element 42 is a piston slidably mounted in the body 34.

The actuator 44 comprises an electric motor 48 coupled with a mechanism 49 (FIG. 4) for transmitting movement to the movement element 42.

The motor 48 is typically a step motor. It is programmed to return to a reference configuration, wherein the angle of the rotor relative to the stator is a reference angle, when the power supply of the motor 48 is switched off. It is also programmed to return to the last operating configuration, wherein the angle of the rotor relative to the stator is an angle previously occupied by the rotor before the power supply was switched off, when the motor 48 is supplied with power again.

The transmission mechanism 49 has been schematically represented in an extremely simple manner in FIG. 4. An example of a transmission mechanism suitable for use within the scope of the invention is given in U.S. Pat. No. 7,629,757.

The battery 46 is electrically connected to the motor 48 by a power supply circuit for the motor 48, for supplying power to the motor 48.

Preferably, it is also electrically connected to a system (not shown) for charging the battery 46 by means of induction. Alternatively or optionally, the battery 46 is electrically connected to an electrical connector (not shown) on the outer surface 26 of the receptacle 20, for electrically connecting the battery 46 to a charging device, the electrical connector being for example of the micro-USB type.

Advantageously, the actuating and movement mechanisms are coupled with the motor 48, in order to be each actuated by the motor 48.

Each application device 10, 12 also comprises an assembly 50 for controlling the electromechanical device 40, and an element 52 for controlling the movement mechanism.

The control assembly 50 is suitable for controlling the electromechanical device 40 so as to adjust the position and/or movement of the cosmetic product 14, 16 relative to the body 34. In particular, in the first embodiment, the cosmetic product 14 being a solid, the position thereof relative to the body 34 is clearly defined: the control assembly 50 is then suitable for controlling the electromechanical device 40 so as to adjust the position and movement of the cosmetic product 14 relative to the body 34. On the other hand, in the second embodiment, the cosmetic product 16 is a fluid material: the control assembly 50 is then suitable for controlling the electromechanical device 40 so as to only adjust the movement of the cosmetic product 16 relative to the cosmetic product 34, which consists in this case of the rate of output of the cosmetic product 16 via the applicator 39.

For this purpose, the control assembly 50 comprises a plurality of touch sensors 54 distributed on the outer surface 26 of the receptacle 20, and a control module 56.

Each touch sensor 54 is suitable, when supplied with electricity, for being actuated merely by touching lightly with a user's finger, and for transmitting an actuation signal to the control module 56 when actuated. For this purpose, each sensor 54 is electrically connected to the control module 56, for the transmission of the actuation signal, and the control of the electricity supply of each sensor 54.

The touch sensors 54 are preferably axially aligned on the outer surface 26.

The control module 56 is electrically connected to the motor 48, for transmitting a control signal to the motor 48.

The control module 56 is programmed to switch the control assembly 50 between two states:

- an idle state when the cosmetic article 22 is in the retracted position, wherein touching the touch sensors 54 has no effect on the electromechanical device 48, and
- an active state when the cosmetic article 22 is in the extended position, wherein each touch sensor 54 is suitable for being actuated, and actuating at least two touch sensors 54 adjacent to each other within a predetermined time interval moves the movement element 42.

For this purpose, the control module 56 is connected to position sensors (not shown), suitable for detecting the position of the cosmetic article 22 relative to the receptacle 20.

The control module 56 is particularly programmed to switch off the power supply of each touch sensor 54 when the control assembly 50 is in the idle state.

The control module 56 is also programmed to, when the control assembly 50 is in the active state, adjust the position and/or movement of the cosmetic product relative to the body according to an actuation pattern of the touch sensors 54. In particular, the control module 56 is programmed to recognize, according to the actuation signals received, a number of actuated touch sensors 54 and an order of actuation of said touch sensors 54, and to measure the actuation rate of the touch sensors 54, and to deduce a control signal from the actuator 44 according to the number of touch sensors 54 actuated, the order of actuation and the actuation rate.

The actuation rate is defined as a ratio between the number of touch sensors 54 actuated and a time interval between the actuation of a first of said touch sensors 54 and the actuation of the last of said touch sensors 54.

Preferably, the control module 56 is programmed to deduce a control signal deducing a movement of the movement element 42:

- away from the outlet orifice 38, when the touch sensors 54 are actuated in an order moving away from the passage slot 28, and
- toward the outlet orifice 38, when the touch sensors 54 are actuated in an order moving toward the passage slot 28.

The control module 56 is also programmed to deduce a control signal inducing a movement of the movement element 42 at a predetermined rate according to the actuation rate measured, the predetermined rate being for example proportional to the actuation rate measured.

The control module 56 is further programmed to deduce a control signal inducing a movement of the movement element 42 over a predetermined distance according to the number of touch sensors 54 actuated, the predetermined distance being for example proportional to the number of touch sensors 54 actuated.

The control module 56 is further programmed to deduce a control signal independent of the position of the touch sensor 54 actuated relative to the other touch sensors 54 of the control assembly 50.

The control module 56 is also programmed to store a position of the movement element 42 relative to the body 34 in memory.

The control element 52 is separate from each touch sensor 54.

The control element 52 is suitable for manual actuation. For this purpose, it comprises an actuating element 58 arranged on the outer surface 26 of the receptacle 20. In the example shown, this actuating element 58 is a toggle switch.

The control element 52 is electrically connected to the motor 48 and to the battery 46. It comprises a switch (not shown) for selectively closing and opening the electricity supply circuit of the motor 48. It is connected to the control module 56 so that:

- actuating the control element 52 in a first direction simultaneously causes the power supply circuit of the motor 48 to close, the closing element 30 to switch to the release position, the cosmetic article 22 to switch to the extended position, the element 42 to move to a last operating position or to a predetermined position, and the control assembly 50 to switch to the active state, and so that
- actuating the control element 52 in a second direction simultaneously causes the power supply circuit of the motor 48 to open, the closing element 30 to switch to the closing position, the cosmetic article 22 to switch to the retracted position, and the control assembly 50 to switch to the idle state.

A cosmetic product application method using the application device 10 shall now be described, with reference to FIGS. 1 to 3.

Firstly, the cosmetic article 22 is in the retracted position in the receptacle 20, and the closing device 30 is in the closing configuration.

The control assembly 50 is idle. In this way, if the user inadvertently touches one or a plurality of touch sensors 54, no effect occurs, the cosmetic product 14 remaining fixed with respect to the body 34.

The user then switches the toggle switch 58 in a first direction. The power supply circuit of the motor 48 is closed, and the motor 48 returns to the last operating configuration thereof or, if the user is using the application device 10 for the first time, to a preprogrammed configuration. In the process, the actuating mechanism, which is coupled with the motor 48, actuates the closing device 30 so that the movable panels 32 release the passage slot 28. The movement mechanism, which is also coupled with the motor 48, then moves the body 34 and the bullet 14 housed therein to extend the body 34 outside the receptacle 20, via the slot 28. Finally, the transmission mechanism 49 raises the cup 42 to the outlet orifice 38, up to the last occupied position.

The control module 56 then controls the activation of the power supply of the touch sensors 54: the control assembly 50 switches to the active state.

Secondly, the user touches a first touch sensor 54 with his/her finger, and moves the finger along the receptacle 20 pressing it down against the outer surface 26 of the receptacle 20, so as to touch other touch sensors 54. In the process, the user brushes against, within a time less than the predetermined time interval, a first number of touch sensors 54 adjacent to each other, for example three, in a direction toward the slot 28, at a first actuation rate. The control module 56 receives the corresponding actuation signals, and deduces a control algorithm therefrom, which is transmitted to the motor 48. The motor 48 is activated, and triggers the movement of the cup 42 and hence the bullet 14, toward the outlet orifice 38, at a first movement rate and over a first distance.

Thirdly, if the user is not satisfied with the position of the bullet 14, he/she touches the touch sensors 54 adjacent with each other a second time. He/she brushes against, within a time less than the predetermined time interval, a second number, for example two, in a direction away from the slot 28, at a second actuation rate, for example less than the first actuation rate. The control module 56 receives the corresponding actuation signals, and deduces a control algorithm therefrom, which is transmitted to the motor 48. The motor 48 is activated, and triggers the movement of the cup 42 and hence the bullet 14, toward the inside of the receptacle 20, at a second movement rate and over a second distance.

In the example given herein, the second actuation rate being less than the first movement rate, the second movement rate is less than the first movement rate and, the second number of touch sensors 54 touched being less than the first number of touch sensors 54 touched, the second distance is less than the first distance.

Finally, once the cosmetic product has been applied, the user switches the toggle switch 58 in the opposite direction. The control assembly 50 then switches to the idle state. The power supply circuit of the motor 48 is open, and the motor 48 returns to the reference position thereof. In the process, the transmission mechanism 49 lowers the cup 42 away from the outlet orifice 38. The movement mechanism then moves the body 34 and the bullet 14 housed therein to retract the body 34 completely into the receptacle 20. Finally, the actuating mechanism actuates the closing device 30 so that the movable panels 32 block the passage slot 28.

A cosmetic product application method using the application device 12 shall now be described, with reference to FIG. 4.

Firstly, the cosmetic article 22 is in the retracted position in the receptacle 20, and the closing device 30 is in the closing configuration.

The control assembly 50 is idle. In this way, if the user inadvertently touches one or a plurality of touch sensors 54, no effect occurs, the cosmetic product 14 remaining fixed with respect to the body 34.

The user then switches the toggle switch 58 in a first direction. The power supply circuit of the motor 48 is closed, and the motor 48 thus returns to the last operating configuration thereof or, if the user is using the application device 10 for the first time, to a preprogrammed configuration. In the process, the actuating mechanism, which is coupled with the motor 48, actuates the closing device 30 so that the movable panels 32 release the passage slot 28. The movement mechanism, which is also coupled with the motor 48, then moves the body 34 and the lip gloss 16 housed therein to extend the body 34 outside the receptacle 20, via the slot 28. Finally, the transmission mechanism 49 is coupled with the motor 48.

The control module 56 then controls the activation of the power supply of the touch sensors 54: the control assembly 50 switches to the active state.

Secondly, the user touches a first touch sensor 54 with his/her finger, and moves the finger along the receptacle 20 pressing it down against the outer surface 26 of the receptacle 20, so as to touch other touch sensors 54.

In the process, the user brushes against, within a time less than the predetermined time interval, a first number of touch sensors 54 adjacent to each other, for example three, in a direction toward the slot 28, at a first actuation rate. The control module 56 receives the corresponding actuation signals, and deduces a control algorithm therefrom, which is transmitted to the motor 48. The motor 48 is activated, and triggers the movement of the piston 42 at a first movement rate and over a first distance. In the process, the pressure of the lip gloss 16 in the chamber 36 increases, and the output of lip gloss via the orifice 38 increases.

Thirdly, if the user is not satisfied with the lip gloss output, he/she touches the touch sensors 54 adjacent with each other a second time. He/she brushes against, within a time less than the predetermined time interval, a second number, for example two, in a direction away from the slot 28, at a second actuation rate, for example greater than the first actuation rate. The control module 56 receives the corresponding actuation signals, and deduces a control algorithm therefrom, which is transmitted to the motor 48. The motor 48 is activated, and triggers the movement of the piston 42 toward the inside of the receptacle 20, at a second movement rate and over a second distance. In the example given herein, the second actuation rate being greater than the first actuation rate, the second movement rate is greater than the first movement rate and, the second number of touch sensors 54 touched being less than the first number of touch sensors 54 touched, the second distance is less than the first distance. In the process, the pressure of the lip gloss 16 in the chamber 36 drops again, and the output of lip gloss via the orifice 38 decreases.

Finally, once the cosmetic product has been applied, the user switches the toggle switch 58 in the opposite direction. The control assembly 50 then switches to the idle state. The power supply circuit of the motor 48 is open, and the motor 48 returns to the reference position thereof. The transmission mechanism 49 is disengaged from the motor 48, such that the piston 42 retains the position thereof relative to the body 34. The movement mechanism moves the body 34 and the lip gloss 16 housed therein to retract the body 34 completely into the receptacle 20. The actuating mechanism actuates the closing device 30 so that the movable panels 32 block the passage slot 28.

By means of the invention described above, application of the cosmetic product is particularly convenient. In particular, this application may be performed by hand. Furthermore, adjusting the movement and/or position of the cosmetic product relative to the body is particularly easy and precise.

In alternative embodiments of the invention, the lipstick bullet according to the first embodiment is replaced by other blocks of cosmetic product, for example correcting foundation, solid perfume, a deodorant stick, or a kohl stick. In further alternative embodiments of the invention, the lip gloss according to the second embodiment is replaced by further cosmetic products in liquid or powder form, for example foundation, eye shadow, blusher, or a treatment cream.

The invention claimed is:

1. An application device for a cosmetic product, comprising a receptacle and a cosmetic article, the cosmetic article being suitable for moving relative to the receptacle between a retracted position inside the receptacle and an extended position outside the receptacle, the cosmetic article comprising a body and the cosmetic product housed inside the body, the body defining an outlet orifice for the cosmetic product, the application device further comprising an electromechanical device for moving the cosmetic product relative to the body, and a control assembly for controlling the electromechanical device for adjusting the position and/or movement of the cosmetic product relative to the body, the control assembly including at least one touch sensor, wherein the control assembly is suitable for switching between:

an idle state when the cosmetic article is in the refracted position, wherein touching at least one touch sensor has no effect on the electromechanical device, and an active state when the cosmetic article is in the extended position, wherein the or each touch sensor is suitable for being actuated by a user, and wherein actuating at least one touch sensor moves the cosmetic product relative to the body by means of the electromechanical device.

2. The application device according to claim 1, wherein the electromechanical device comprises an element for moving the cosmetic product and an actuator for actuating the movement element.

3. The application device according to claim 2, comprising a mechanism for moving the cosmetic article between the retracted and extended positions thereof, and an element for controlling the movement mechanism, suitable for manual actuation and separate from the or each touch sensor.

4. The application device according to claim 3, wherein the movement mechanism is coupled with the actuator of the electromechanical device in order to be actuated by said actuator, the control element being electrically connected to said actuator.

5. The application device according to claim 1, wherein, in the extended position of the cosmetic article, the body extends at least partially outside the receptacle.

6. The application device according to claim 1, wherein the cosmetic product is a cosmetic product block.

7. The application device according to claim 6, wherein the cosmetic product is a lipstick bullet.

8. The application device according to claim 1, wherein the cosmetic product is in liquid or powder form, and the cosmetic article comprises a cosmetic product applicator arranged through the outlet orifice.

9. The application device according to claim 1, wherein the control assembly comprises a plurality of touch sensors and a control module programmed to adjust the position and/or movement of the cosmetic product relative to the body according to an actuation pattern of the touch sensors.

10. The application device according to claim 9, wherein the actuation pattern has an actuation rate of the touch sensors, and the control module is programmed to set a movement rate of the cosmetic product according to said actuation rate.

11. The application device according to claim 10, wherein the movement rate is proportional to said actuation rate.

12. The application device according to claim 1, comprising a mechanism for moving the cosmetic article between the retracted and extended positions thereof, and an element for controlling the movement mechanism, suitable for manual actuation and separate from the or each touch sensor.

13. The application device according to claim 1, comprising a power supply which supplies power to the or each touch sensor, said power supply being switched off when the control assembly is in the idle state.

14. A cosmetic product application method, comprising the following successive steps:

providing the application device according to claim 1, the cosmetic article being in the retracted position, the control assembly being idle, moving the cosmetic article to the extended position, the control assembly being activated in the extended position, actuating at least one touch sensor, and moving the cosmetic product relative to the body.

15. The application method according to claim 14, wherein at least two touch sensors are actuated, and the movement of the cosmetic product relative to the body is dependent on the number of touch sensors actuated and/or an order of actuation of said touch sensors and/or an actuation rate of said touch sensors.

16. The application method according to claim 15, wherein the movement of the cosmetic product is independent of the position, relative to the other touch sensors, of the first touch sensor which was first actuated.

* * * * *